US007604671B2

(12) United States Patent
Fadel et al.

(10) Patent No.: US 7,604,671 B2
(45) Date of Patent: Oct. 20, 2009

(54) PERFUMERY FOR IMPROVED COLD THROW AND BURN IN CANDLE SYSTEMS

(75) Inventors: Addi Fadel, Shelton, CT (US); Richard Turk, Plymouth, MA (US); Grant Mudge, West Redding, CT (US); Jill Mattila, Greensboro, NC (US); Robert Burke, Boynton Beach, FL (US)

(73) Assignee: Givaudan Fragrances Corporation, Mount Olive, NJ (US)

( * ) Notice: Subject to any disclaimer, the term of this patent is extended or adjusted under 35 U.S.C. 154(b) by 640 days.

(21) Appl. No.: 11/171,718

(22) Filed: Jun. 30, 2005

(65) Prior Publication Data

US 2006/0003031 A1 Jan. 5, 2006

Related U.S. Application Data

(60) Provisional application No. 60/584,003, filed on Jun. 30, 2004.

(51) Int. Cl.
*C10L 7/00* (2006.01)
*C10L 5/00* (2006.01)
*C11C 5/00* (2006.01)

(52) U.S. Cl. ..... 44/275; 512/1

(58) Field of Classification Search ..... None
See application file for complete search history.

(56) References Cited

U.S. PATENT DOCUMENTS 5,849,310 A * 12/1998 Trinh et al. ..... 424/401
6,458,754 B1 10/2002 Velazquez et al. ..... 510/441
6,741,954 B2 5/2004 Sonnenberg et al. ..... 703/2
6,858,574 B2 2/2005 Yang et al. ..... 512/1
7,220,288 B2 * 5/2007 D'Amico et al. ..... 44/275
2002/0169091 A1 11/2002 Clare et al. ..... 510/220
2003/0008787 A1 * 1/2003 McGee et al. ..... 510/101
2003/0064336 A1 4/2003 Welch et al. ..... 431/288
2003/0110682 A1 6/2003 Williams et al. ..... 44/275
2004/0031191 A1 2/2004 D'Amico et al. ..... 44/275
2004/0068920 A1 4/2004 Steele et al. ..... 44/275
2004/0221503 A1 * 11/2004 Murphy et al. ..... 44/275
2005/0124512 A1 6/2005 Woo et al. ..... 510/101

FOREIGN PATENT DOCUMENTS

WO WO 97/34988 9/1997

OTHER PUBLICATIONS www.sigmaaldrich.com (Mar. 8, 2001).*

* cited by examiner

*Primary Examiner*—Cephia D Toomer
*Assistant Examiner*—Chantel Ferguson-Graham
(74) *Attorney, Agent, or Firm*—Morgan Lewis & Bockius LLP

(57) ABSTRACT

A fragrance composition for use in hydrophobic systems, such as candles, comprising at least one odorant selected for having a minimum cold throw value (Ω) and a minimum hot throw value (η) is disclosed. A method of formulating a fragrance composition for hydrophobic systems, such as candles, comprising selecting at least one odorant to form a desired fragrance, each odorant having a minimum cold throw value (Ω) and hot throw value (η), and incorporating the fragrance into a hydrophobic carrier, such as wax material, is disclosed.

33 Claims, 10 Drawing Sheets

PERFUMERY FOR IMPROVED COLD THROW AND BURN IN CANDLE SYSTEMS

PRIOR APPLICATION

Applicants claim priority benefits under 35 U.S.C. § 119(e) of U.S. Provisional Patent Application Ser. No. 60/584,003 filed Jun. 30, 2004.

FIELD OF THE INVENTION

The present invention relates to perfumes for blooming candle systems. More specifically, this invention encompasses blooming perfumes optimized for diffusion under ambient and burn temperature-conditions using odorants' mass transfer and physical properties in various wax systems under the above said conditions along with modeled odor detection values in air.

BACKGROUND OF THE INVENTION

Perfumes and odorants are designed for optimized performance in terms of "throw" of fragrance as detected by the consumer. The intensity of the fragrance at ambient temperatures is termed "cold throw." Additionally, particularly relevant to candle systems, the intensity of a fragrance during burn is termed "burn throw" or "hot throw."

In the field of perfumery, many have addressed the formulation of fragrances that achieve improved cold throw of fragrances in water-based systems. For instance, U.S. Patent Application Publication No. 2002/0169091 and PCT Application 97/34988 address use of odorants with a cLogP greater than 3 to achieve cold throw of fragrances in water-based systems.

Additionally, improved cold throw in wax-based, hydrophobic systems address cold throw of fragrance. U.S. Patent Application Publication No. 2003/0064336 to Welch et al. employs odorants having clogP values less than about 2.7, boiling points less than about 240° C. and requires that they be entrapped into porous inorganic carrier particles such as zeolite.

U.S. Patent Application Publication No. 2003/0110682 to Williams et al., directed to a transparent, vegetable-based candle, discloses fragrance compositions with each fragrance component having a cLogP between 2.5 and 8.0.

There remains a need in the art for improved throw of fragrances in hydrophobic, wax-based systems, and methods of formulating fragrances by identifying and predicting parameters of odorants to select them for use in fragrances in wax-based systems, optimizing fragrance throw under varying conditions of use, whether cold throw or during burn of the candle.

SUMMARY OF THE INVENTION

In one aspect of the present invention, a candle optimized for cold and hot throw of fragrance comprising a wax material, at least one odorant to form 20% by weight of a fragrance incorporated into the wax material, each odorant selected for having a cold throw value (Ω) of at least about $$1\times10^{-8}\left(\frac{\text{mg}\cdot\text{cm}}{\text{cm}^2\cdot\text{sec}^2}\right)\cdot\frac{1}{\text{sec}},$$

and a hot throw value (η) of at least about $$0.01\left(\frac{\text{g}\cdot\text{cm}}{\text{cm}^2\cdot\text{sec}^2}\right)*\frac{\text{cm}^2}{\text{sec}},$$

is provided.

In another aspect of the present invention, a fragrance composition for use in hydrophobic systems, comprising at least one odorant to form 20% by weight of a desired fragrance, each odorant having: cold throw value (Ω) of at least about $$1\times10^{-8}\left(\frac{\text{mg}\cdot\text{cm}}{\text{cm}^2\cdot\text{sec}^2}\right)\cdot\frac{1}{\text{sec}}$$

and hot throw value (η) of at least about $$0.01\left(\frac{\text{g}\cdot\text{cm}}{\text{cm}^2\cdot\text{sec}^2}\right)*\frac{\text{cm}^2}{\text{sec}},$$

and a hydrophobic carrier containing the fragrance.

In yet another aspect of the present invention, a method of fragrance optimization in hydrophobic systems comprising providing a wax material, selecting at least one odorant to form 20% by weight of a desired fragrance, each odorant having cold throw value (Ω) of at least about $$1\times10^{-8}\left(\frac{\text{mg}\cdot\text{cm}}{\text{cm}^2\cdot\text{sec}^2}\right)\cdot\frac{1}{\text{sec}}$$

and hot throw value (η) of at least about $$0.01\left(\frac{\text{g}\cdot\text{cm}}{\text{cm}^2\cdot\text{sec}^2}\right)*\frac{\text{cm}^2}{\text{sec}},$$

and incorporating the fragrance into the wax material is provided.

DETAILED DESCRIPTION OF THE DRAWINGS

Figure 1:
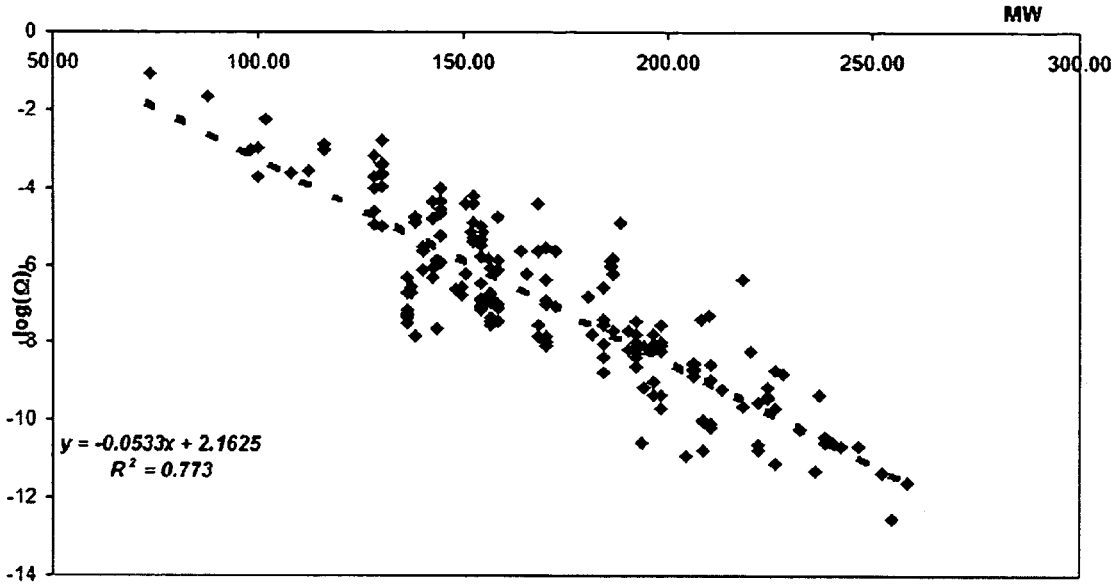
FIG. 1 is graph showing the relationship between cold throw and molecular weight of odorants according to the present invention.

A candle's cold throw of fragrance is an important and decisive factor when a consumer purchases a candle in a retail store, as the fragrance and its intensity is detectable when sitting on the shelf. The candle's hot throw of fragrance is another important factor in the consumer's decision to buy the candle more than once since it relates to the intensity, and the appeal of the fragrance during the burning of the candle by the consumer, or more specifically during the formation of molten wax pool at the top of the candle.

There remains a need to construct fragrances for superior impact both before and during burns in wax-bases systems, and methods for predicting their cold and/or hot throw such that most efficient, best performing odorants can be employed in formulating fragrances in wax-based systems, such as candles.

The present inventions achieves fragrances for wax-based systems and a methods of formulating fragrances in wax-based systems comprising odorants selected for improved cold and/or hot throw based upon "hot throw" and/or "cold throw" values. Odorants chosen herein have specific values for physical properties such as volatility, diffusivity coefficients, molecular weight, polarity and calculated odor intensity in air as deduced according to the model described in this invention.

An object of this patent is to improve candle fragrance throw using physical properties of fragrance materials and their optimization based on their behavior in various wax crystalline structures at room temperature and during the formation of a molten wax pool during burn. Values such as calculated critical parameters, volatility, hydrophobicity, diffusivity in paraffin, solvent and air, size, as well as calculated odor indices are all used to select optimal fragrance materials to bring about improved cold throw and burn performance in a candle.

The fragrance compositions and methods of the present invention may be applied to any wax-based system, operating at ambient temperatures ("cold throw") and/or warm or melt conditions ("hot throw").

A model was engineered based on mass transfer equations further described in the herein patent, to construct fragrances for superior impact before and during burn. Odorants chosen herein have specific values for simple physical properties such as volatility, diffusivity coefficients, molecular weight, polarity and calculated odor intensity in air as deduced according to the model described in this invention.

Candles vary in composition depending upon their form and function. For instance, a jar candle which is contained within a glass container may be relatively soft and the wax material thereof may be packed relatively loosely. Consequently, loosely packed wax material with large, numerous interstitial spaces containing perfume or odorants can better throw fragrance. In contrast, pillar candles which by design must be rigid and dense enough to stand on their own, are relatively hard, their composing wax material packed more tightly. As a result, in harder candle, fragrance throw is more difficult to achieve.

The most common base material for making candles is paraffin. Paraffin is a very complex mixture of hydrocarbons, frequently quantified by a range of melting points and penetration. Paraffin vary widely in key parameters such as oil content, presence or absence of aromatic compounds, and proportion of straight and branched chains hydrocarbons (S. Herman Global Cosmetic Industry; February 2003; 171, 2 p 52).

Manufacturing the candles of the present invention may be done using any generally acceptable methods known in the art. As known in the art, candles typically are made of wax materials, including but not limited petroleum-derived paraffin and vegetable-derived wax, such as soy and palm waxes. The wax material component is melted to form a wax melt, and the fragrance component, a solution including odorants and other additives and diluents, are integrated into the wax melt. One the fragrance component is added to the wax melt, the mixture is poured in a suitable mold for the manufacture of the candle. A wick is placed in the mold surrounded by the melt or one can insert the wick by drilling a hole in the shaped candle after cooling and solidification.

According to the present invention, the perfume or fragrance component, including selected odorants or combination of odorants and any additional additives and diluents, preferably comprises at least 0.1% by weight of the candle, preferably 4% to 8% by weight, and most preferably 0.5% to 6% by weight. The selected odorant or odorants in total comprise at least 20% and preferably at least 30% of the fragrance component.

Candles according to the present invention are comprised of any suitable wax material known in the art. Preferably, the wax material is paraffin. Alternatively, the wax material may be a vegetable wax or combination of vegetable waxes, particularly those derived from palm or soy. Alternatively, the wax material may be a combination of paraffin and vegetable wax. These vegetable waxes are attractive as renewable, green "raw "materials. They are mixture of hydrogenated and non-hydrogenated glycerides. Typically, vegetable-derived waxes have larger interstitial spaces than does paraffin.

These paraffin and vegetable derived waxes often have a highly crystalline component at room temperature with varied range of structural order depending on the wax system. These stable multi-component solid solutions have been extensively studied using X-ray crystallography techniques to unveil their packing properties (Dorset, D. L. Structural Chemistry, Vol. 13, 3/4 p 329; Dorset, D. L. Appl. Phys 30 (1997) 451-457; Dorset, D. L. Appl. Phys. 32 (1999) 276-1280; Dorset, D. L. Acta Cryst (1995), B51, 1021-1028). The X-ray crystal structures of the wide range of the wax types studied show a stable lamellar chain packing with irregular interstitial spaces or gaps. The lamellar x-ray spacing for a wax would depends on the mean chain length of the polydisperse chain distribution.

The addition of different additives such as polymers, along with the pouring temperatures, can greatly alter and subsequently increase the interstitial spaces between the chains of these crystalline structures. Candle waxes, and paraffin in particular, are also highly non-polar or hydrophobic mixtures.

Without addition of any additives, the crystal structure of paraffin can be summarized as follows:

- the distance between two adjacent paraffin molecules, i.e. gaps, is about 4.5-5.5 Angstroms (Å), and
- the angle between the symmetry planes of two adjacent paraffin molecules, i.e., it should be about 82 degrees (°).

As additives are added to the wax system, the gaps between adjacent paraffin molecules will dramatically increase, effecting the performance and delivery of fragrance materials that are dispersed in the hydrophobic partition.

Typical additives to the perfume or fragrance component, which in turn are incorporated into the wax material, include, but are not limited to, colorants such as oil-soluble dyes and pigments, anti-oxidants (as disclosed in U.S. Patent Application No. 2004/0031191 to D'Amico et. al., incorporated herein by reference), UV-absorbers, diluents, insect repellants. These additives may modify the properties of the waxy material.

Fragrance odorants are small molecular weight substances with a vapor pressure that allows their molecules to evaporate, become airborne, and eventually reach the olfactory organ of a living entity. There is a variety of different fragrance materials with different functional groups and molecular weights, both of which affect their vapor pressures, and hence, the ease with which they can be sensed.

Hydrophobicity of an odorant or fragrance molecule can be measured using logP value, a physico-chemical property. The octanol/water partition coefficient (P) of a fragrance molecule is the ratio between its equilibrium concentrations in octanol and in water. Since the partitioning coefficients of the perfume ingredients of this invention have high values, they are more conveniently given in the form of their logarithm to the base 10, logP. Odorants with cLogP value less than about 1.5 will sometimes cause sublimination since they are totally incompatible with the paraffin or other type of wax. Therefore a minimum value for cLogP within the considered pool of odorants needs to be brought in to ensure some compatibility with the waxy non-polar environment.

According to the present invention, an odorant molecule preferable has a cLogP value from about 1.5 to about 4.5 and preferably from about 2.0 to about 3.5.

Boiling point values of fragrance materials are an indication of their volatility. Values below about 250° C. are usually indicative of increased volatility. The boiling points of many perfume ingredients are given in e.g. Perfume and Flavor Chemicals (Aroma Chemicals), Steffen Arctander. In addition, various algorithms are available to predict theoretically these values, as well. See Joback and R. Reid, Chem. Eng. Comm. 57: 233-243 (1987); P. Myrdal, J. Krzyzaniak, S. Yalkowsky, Ind. Eng. Chem. Res. 35: 1788-92 (1996); P. Myrdal, S. Yalkowsky, Ind. Eng. Chem. Res. 36: 2494-99 (1997); Handbook of Chemical Property Estimation Methods, W. J. Lyman, W. F. Reed, D. H. Rosenblatt, McGraw Hill (1982).

According to the present invention, preferred odorant molecules have experimentally deduced and/or calculated boiling point values less than about 275° C. and more preferably less than about 250° C. at atmospheric pressure.

The size of the fragrance molecule is important in the present inventions when optimizing fragrances for better impact before burn. As shown later in the model, the authors correlated the size of odorants with the ability of a material to travel through the paraffin or vegetable wax interstitial space using these odorants' molecular weight values. According to the present invention, preferred fragrance molecules have molecular weight values less than about 200.

"Odor Index" (O.I.) is a term used by the authors to define is a calculated value related to odor detection thresholds of odorants in air. The odor indices are calculated using an algorithm to measure the transfer of energy between an odorant and the binding site of a modeled human binding protein during "docking". The conformation of the odorant deduced from docking experiments into the human odorant binding protein is used to measure through a mathematical model, the energy transfer between the ligand and the protein receptor. This value is used to set forth the last parameter for the preferred odorants for this invention.

The performance of a perfume in a candle is based on both "cold throw" and "hot throw." "Cold throw" is term used to describe the impact of the perfume before burn, whereas "hot throw" is the impact of the perfume during the burning process of the candle. The object of this invention is to optimize both "cold throw" and "hot throw" of candle systems by choosing odorants with specific physical and hedonic properties. These properties were determined using mass transfer equations to model the behavior of these materials in waxy systems under cold and burn conditions and algorithms to quantify odor index values, which are strongly correlated to the odor detection threshold values of these odorants in air.

Flux as well as pseudo-acceleration values are shown in this invention to model the ability of an odorant to travel through a paraffin system under "cold" conditions. These values coupled with calculated odor index values are further used to quantify the odor impact of odorants in these systems.

Hot throw properties are theoretically predicted by calculating diffusivity and vapor pressure values of odorants at high temperatures and further introducing odor index values to accurately characterize odor impact of these odorants during wax melting temperatures.

1. Cold Throw Properties of Odorants

The "cold throw" properties of odorants are based on calculated pressure values through the waxy system per area and time. These pressure values are calculated as the product of a "pseudo-acceleration" term obtained using a dimensional analysis method and a "flux" value for these odorants in the considered wax.

Wax systems are assumed to be porous media with pore sizes of minimum values between about 4.5 and about 5.5 angstroms as described in the crystal structures of paraffin wax. These values are very restrictive since the introduction of various additives such as dyes in candles will ultimately greatly increase the pore size of the partition during candle manufacture. Furthermore, these wax systems are thought to be highly non-polar and therefore odorant with high clogP values are also assumed to undergo hydrophobic interactions with the hydrocarbon chains that make up these candles.

The hydrophobic partitioning is assumed to be non competitive, and strongly associated with the odorant's hydrophobicity, normally expressed by water-octanol partition coefficient P.

These hydrophobic interactions in the non-polar partition are taken into consideration when calculating flux and pseudo acceleration values of odorants in the hydrophobic, porous waxy partition.

a. Pseudo Acceleration (Γ) Values

In the analysis of the volatility of odorants, several variables are found to be important. First, the vapor pressure of the odorant is an important measure of its volatility. The product of the odorant's activity coefficient γ, its mole fraction X, in the partition and its pure vapor pressure value $P_v$, gives the odorant's relative vapor pressure. A second important factor for volatility is the diffusivity $D_{12}$ of the odorant in the solvent vapor phase (e.g. paraffin).

Other important variables to consider are the molecular weight $M_w$, of the odorant and its density in the partition $\rho_l$ and in the solvent vapor state $\rho_v$. The final variable to consider is an energy parameter in the partition state. The energy difference $\epsilon_{12}=\epsilon_{12}-\epsilon_{12o}$ is proportional to the partition coefficient of an odorant in a polar solvent such as water, and a water immiscible solvent such as octanol, benzene and paraffin liquid. The energy $\epsilon_{12}$ is called the partition energy and can be correlated to the clogP value of odorants.

The five variables $D_{12}$, $P_v$, Mw, $\rho_v$ and $\epsilon_{12}$ and the three dimensional variables indicate that there can be 5–3=2 dimensional variables which describe Newton's law. The easiest separation is to break the acceleration vector into 2 dimensional quantities: a frequency or first order rate constant (1/time) and a velocity (distance/time) term.

The velocity group can be formed from the vapor pressure and density. Since pressure has units of mass/distance.time$^2$, and density has units of mass/distance$^3$, the ratio of the two has units of velocity squared. The square root gives the desired velocity.

The first order rate constant can be formed from the variables Mw, $D_{12}$ and $\epsilon_{12}$. Since the partition energy $\epsilon_{12}$ has dimensions of calories per mole (mass.length$^2$/mole.time$^2$) and the diffusivity coefficient Dab has a dimension of distance per time, the ratio yields exactly a molecular weight unit. The energy can be made dimensionless by dividing by the gas constant k and temperature T. The remaining variable $D_{12}$ can be made to a frequency by dividing by a cross sectional area $L^2$. A molecular area calculated from the liquid molar volume could represent this area.

b. Flux Values, $\phi$

Flux of odorant (1) in partition (2) $\phi_{12}$ is defined as the ratio of the quantity of odorant being transferred in the medium divided by the time and area of the contained medium. Flux values can also be defined in relation to a concentration gradient of the odorant throughout a partition z according to:

$$\Phi_{12} = -D_{12}\left(\frac{d(c_1)}{dz}\right) \quad [1]$$

where:

$D_{12}$ is the diffusion constant of odorant (1) in partition (2)

$$\left(\frac{d(c_1)}{dz}\right)$$

is the concentration gradient of odorant (1) throughout the partition.

The diffusivity coefficient $D_{12}$ in expression [1] is calculated as follows. The overall diffusion coefficient of the odorant through the wax partition is:

$$D_{12} = \frac{1}{D_{inv}}\alpha^2 \quad [2]$$

with $$D_{inv} = \frac{1}{D_a} + \frac{1}{D_b} \quad [3]$$

$D_a$ is calculated using the *Slattery Kinetic Theory* for air with non-polar odorants using odorants' critical parameters (See Slattery J. C. and Mhetar V. (1996) Unsteady state evaporation and measurement of binary diffusion coefficient. Chem. Eng. Sci. 52, 1511-1515) and $D_b$ is the Knudsen diffusion coefficient.

The Knudsen diffusion coefficient relates the diffusion through a pore size with size of an odorant correlated to its molecular weight value, (See C. V Heer, Statistical Mechanics, Kinetic Theory, and Stochastic Processes, Academic Press 1972.

It is calculated according to the method of Satterfield and Sherwood, (See Satterfield, C. N. and Sherwood, T. K. (1963), the Role of diffusion in catalysis. Reading, Mass. Addison-Wesley). The waxy partition is assumed to be porous as shown in the X-ray crystallography data for paraffin and vegetable derived wax. The mass transfer of odorants in the waxy partition is assumed to be in a continuum description of Knudsen diffusion throughout the hydrophobic porous medium, and the movement of odorants is approximated to be independent of one another and all other additives present in the partition except for the hydrocarbon chains.

$\alpha$ is the candle wax void fraction, determined experimentally.

Hydrophobic interactions between the hydrocarbon chain in the waxy medium and the odorants are taken into consideration when determining the calculated concentration of odorants in headspace. This hydrophobic partitioning is taken into consideration when solving for the dimensionless velocity value determined by the Arnold equation. See Arnold, J. H. Studies in Diffusion: III. Unsteady State Vaporization and Absorption. Trans. Am. Inst. Chem Eng., 40, 361-378.

2. "Hot Throw" Properties of Odorants

The hot throw or in other words, burn properties of odorants are based on calculations for vapor pressure and diffusivity constants in air for odorants at melting temperatures for various wax systems.

a. Vapor Pressure Values, $V_p$

Vapor pressure values are calculated based on odorants critical properties according to two methods: Frost Kalkwarf Thodos and the Miller semi-reduced method. See K. Joback and R. Reid, Chem. Eng. Comm. 57: 233-243 (1987) A. L. Lydersen, Coll. Eng. Univ. Wisconsin. Eng. Expt. Sta. Rept. 3, Madison Wis., April, 1955; Entropy of boiling: P. Myrdal, J. Krzyzaniak, S. Yalkowsky, Ind. Eng. Chem. Res. 35: 1788-92 (1996); Heat capacity change on boiling: P. Myrdal, S. Yalkowsky, Ind. Eng. Chem. Res. 36: 2494-99 (1997); Handbook of Chemical Property Estimation Methods, W. J. Lyman, W. F. Reed, D. H. Rosenblatt, McGraw Hill (1982).

b. Diffusivity Constants, $D_{ao}$

The diffusivity constants for odorants in air are calculated based on Slattery low-pressure kinetic theory method. See Advanced Transport Phenomena, John C. Slattery, Cambridge University Press, 1999.

3. Odor Index Values, (O.I.)

By introducing the odor index values of odorants, the inventors can further measure the perceived intensity of the designed perfumes during cold and burn conditions. These odor index values are directly related to odor detection threshold values. Odor detection threshold is generally defined as the lowest concentration of a substance in a chosen medium or solvent that can be perceived by the sense of smell by a majority of a target population, often a panel. These odor index values are calculated according to a mathematical model described in details later in the invention. The model calculates the energy transfer between the docked odorant conformation and a modeled structure of human odorant binding protein, expressed in the human olfactory epithelium.

a. Human Odorant Binding Proteins.

Odorant binding proteins (OBPs) are small water-soluble proteins that are approximately 19 kDa in size (See Pevsner J., Hou V., Snowman A., Snyder S., J. Biol. Chem. 1990, 265, 6118, Odorant Binding Proteins: Characterization of Ligand Binding). OBPs were suggested to play an important physiological role in olfaction based on their ability to bind to a variety of odorants as well as their localization in the nasal cavity.

A variety of functions ranging from buffer mechanisms prior to receptor binding to transport proteins to odorant receptors through the hydrophilic aqueous mucous surrounding the odorant receptors (Ors) have been suggested. OBPs have also been suggested to play a transducer role as the odorant are presented to the ORs as complexes, bound to the OBPs. This model allows for discrimination of odors by OBPs and not purely by the receptors in the olfactory epithelium (See Pelosi P. and Maida R., Chem. Senses 1990, 15, 217, Odorant Binding Proteins in Vertebrates and Insects, similarities and possible common functions).

Two odorant binding proteins were detected in humans: $hOBP_{IIa}$ and $hOBP_{IIb}$. Although 95% similar in sequence, $hOBP_{IIa}$ was found to be expressed in the nasal structures, salivary and lachrymal glands whereas hOBPIIb was found in the genital sphere organs such as prostate and mammary glands (See Lacazette E., Gachon A. M., Pitiot G., Human Molecular Genetics, 2000, 9, 2, 289-301, A Novel Human Odorant Binding Protein Gene Family resulting from genomic duplicons at 9q34: differential expression in the oral and genital spheres).

$hOBP_{IIa}$ was further localized in the human olfactory mucus covering the olfactory cleft, where the sensory olfactory epithelium is located. In addition, it was found that $hOBP_{IIa}$ has the ability to bind to a large variety of odorant of different chemical structures with limited specificity to aldehydes and large fatty acids (See Briand, L; Eloit, C.; Nespoulos, C.; Bezirard, V.; Huet, J. C.; Henry, C., Blon. F., Trotier, D., Pernollet, J. C., Biochemistry 2002, 41, 7241-7251, Evidence of an odorant-binding protein in the human olfactory mucus: location, structural organization and odorant binding properties)

The dissociation constant for hOBP Ha as in the case of other vertebrate's OBP such as porcine OBP and bovine OBP, was found to be in the micromolar range, indicating relatively weak binding activity to odorants (See Pelosi, P. (1990), Odorant Binding Proteins, Critic. Rev. Biochem. Mol. Biol. 29, 199-228; Pevsner J., Hou V., Snowman A., Snyder S., J. Biol. Chem. 1990, 265, 6118, Odorant Binding Proteins: Characterization of Ligand Binding; Matarazzo, V., Szurger, N., Guillemot, J. C., Clot-Faybesse, O., Botto, J. M., Dal Farra, C., Crowe, M., Demaille J., Vincent, J. P., Mazella, J., Ronin, C., Porcine Odorant Binding Protein Selectively Binds to Human Olfactory Receptor, Chem. Senses 27: 691-701; 2002). It has been demonstrated that odorants belonging to a wide range of chemical classes and unrelated chemical structure can bind to porcine OBP (pOBP) with similar affinities by interacting with different amino acids in the binding pocket (Vincent, F., Spinelli, S., Ramoni R., Grolli, S., Pelosi, P., Cambillau, C., Tegoni, M., (2000) Complexes of porcine odorant binding protein with odorant molecules belonging to different chemical classes, J. Mol. Biol. 300, 127-239).

The relatively weak binding of the odorants to the binding cavity of odorant binding protein was primarily found to be dependent on the size and length of the odorant, an indication of non-specific hydrophobic interaction within the binding cleft (See Nespoulos C., Briand, L., Delage M. M. Tran, V., and Pernollet J. C., Odorant Binding and Conformational Changes of a Rat Odorant-Binding Protein Chem. Senses 2004, 29: 189-198).

During the process of olfaction, the first steps in odorants recognition is likely to be attributed to a somewhat non selective binding to odorant binding proteins, which will transport these odorants through the mucous layer to the receptors in the olfactory membrane. The first step in the G protein mediated signal transduction is therefore mediated by a generally thought to be non-specific binding mechanism to OBPs.

The binding of odorants to a modeled OBP was based on a scoring function (odor index or "O.I.") that estimates ligand-binding affinity using descriptors that can be rapidly measured from the ligand receptor interaction and most importantly the inherent physical and chemical properties of the odorant itself. These odor index values are defined based on the Lydersen tables of critical properties, which are closely related to the length and size of the odorant molecules. In addition, odorants' functional groups along with shape of the odorant in conformations resulting from docking experiments with modeled human odorant binding protein structure ($hOBP_{IIa\square}$), stereochemistry, polarity, diffusivity in air, and exerted force calculated during the docking process into the odor receptors' pocket. (See Reid, R. and Sherwood, T, Properties of gases and liquids, $2^{nd}$ Edition, McGraw, Hill N.Y. (1966) p. 9).

Given a particular ligand and receptor, the determinants of binding are largely hydrophobic and non-specific. Given the three-dimensional structure of a particular compound bound within the modeled hOBP active site, we can rapidly calculate the values for additional descriptors such as the odorants' translational, rotational and translational energy, size, stereochemistry and polarity, all thought to be important factors in determining how odorants are transduced during the initial steps of the olfactory process.

4. Selecting Odorants Based Upon Cold Throw Values (Ω)

Cold throw Value (Ω) was determined as being the product of the pseudo-acceleration factor (Γ) and the calculated flux (ϕ) of odorants out of the waxy partition, according to methods described above.

When considering the units of Ω expressed in the model as being:

$$\left(\frac{\text{mg}\cdot\text{cm}}{\text{cm}^2\cdot\text{sec}^2}\right)\cdot\frac{1}{\text{sec}}.$$

One can rewrite the units as being equivalent to $$\left(\frac{\text{Force}}{\text{Area}}\right)\cdot\frac{1}{\text{sec}}$$

or also in other terms, as pressure per time. The cold throw values can then be defined as being equivalent to an expression of odorant's pressure out of the partition (wax) per time (sec). All results described herein were determined assuming straight paraffin C-30 wax.

Odorants employed in wax-based systems and method according to the present invention are selected base upon having a cold throw value (Ω) of at least about $$1\times10^{-8}\left(\frac{\text{mg}\cdot\text{cm}}{\text{cm}^2\cdot\text{sec}^2}\right)\cdot\frac{1}{\text{sec}},$$

and preferably, at least about $$1\times10^{-7}\left(\frac{\text{mg}\cdot\text{cm}}{\text{cm}^2\cdot\text{sec}^2}\right)\cdot\frac{1}{\text{sec}}.$$

Figure 2:
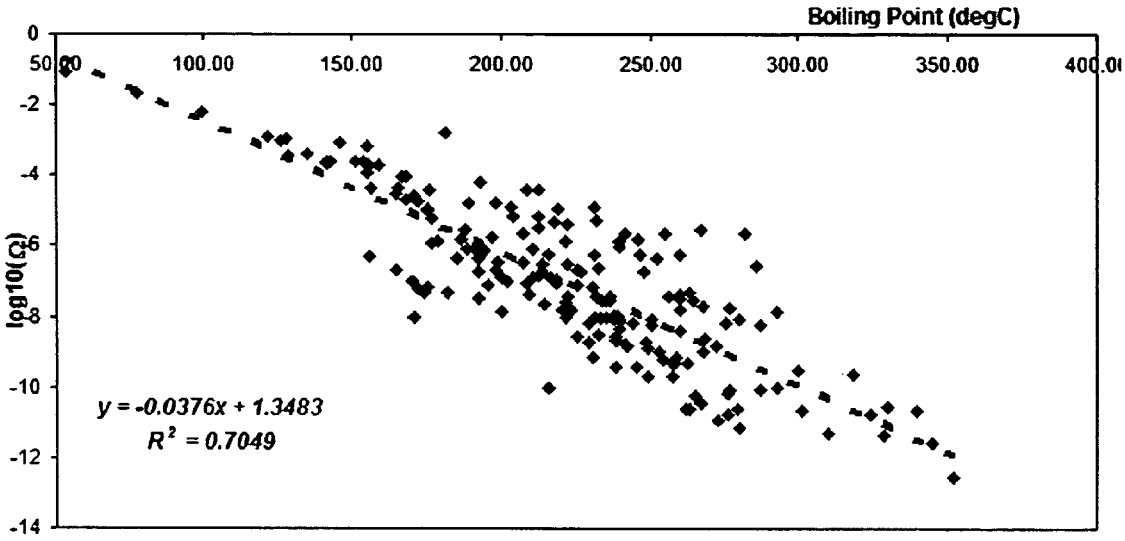
FIG. 2 is graph showing the relationship between cold throw and molecular weight of odorants according to the present invention.
Figure 3:
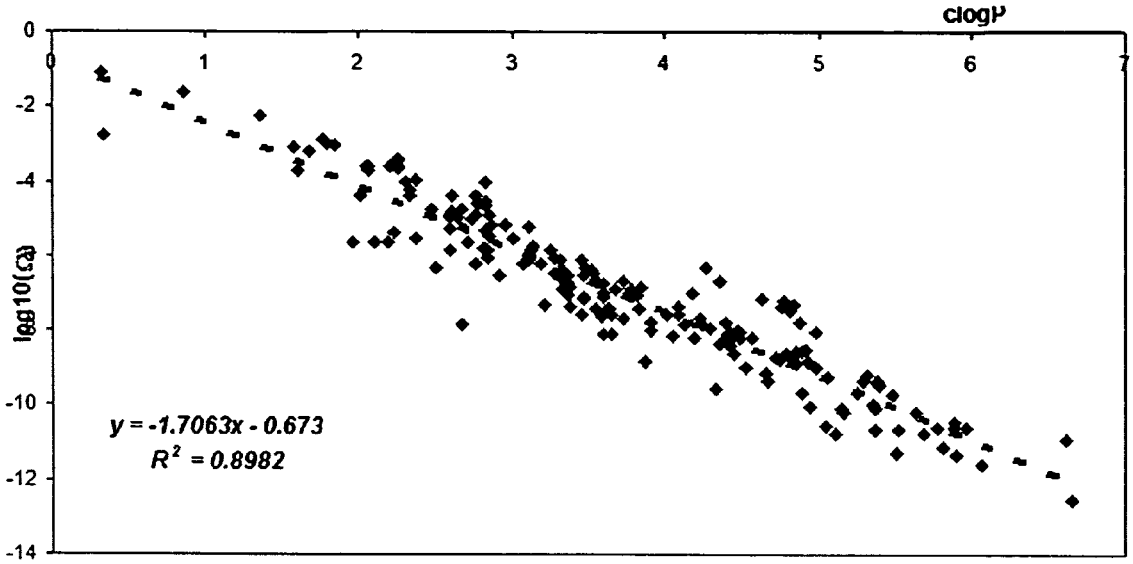
FIG. 3 is graph showing the relationship between cold throw and boiling point values of odorants according to the present invention.

As shown in FIGS. 1-3, based on the model, values for boiling point (° C.), clogP and molecular weight as an indication of size are important factors in selecting for odorants for cold throw. Odorants with a molecular weight of about 200 or less, clogP of less than about 4.5, and boiling point less than about 275° C. are selected by the model to give the best cold throw values.

5. Selecting Odorants Based Upon Hot Throw Values (η)

Hot throw values were taken as the product of air diffusivity coefficient ($cm^2$/sec) and vapor pressure (atm) values both calculated at temperatures that result in formation of molten wax pool at the top of the candle. When considering the units of the hot throw value η, it is expressed as the product of atm and $cm^2$/sec units, equivalent to $$\left(\frac{\text{g}\cdot\text{cm}}{\text{cm}^2\cdot\text{sec}^2}\right)*\frac{\text{cm}^2}{\text{sec}},$$

also equivalent to a measure of $$\frac{\text{Force}}{\text{sec}}.$$

The model assumes collapse of the crystal structure of sec the wax and diffusion out of the molten wax liquid.

Odorants employed in wax-based systems and method according to the present invention are selected base upon having a hot throw value (η) of at least about $$0.01\left(\frac{\text{g}\cdot\text{cm}}{\text{cm}^2\cdot\text{sec}^2}\right)*\frac{\text{cm}^2}{\text{sec}},$$

and preferably at least about $$0.02\left(\frac{\text{g}\cdot\text{cm}}{\text{cm}^2\cdot\text{sec}^2}\right)*\frac{\text{cm}^2}{\text{sec}}.$$

a. Hot Throw Dependence on Boiling Point (° C.) and Enthalpy of Vaporization ($\Delta H_{vap}$), The heat of vaporization values were calculated according to the Miller semi-reduced methods. Entropy of boiling: P. Myrdal, J. Krzyzaniak, S. Yalkowsky, Ind. Eng. Chem. Res. 35: 1788-92 (1996); Heat capacity change on boiling: P. Myrdal, S. Yalkowsky, Ind. Eng. Chem. Res. 36: 2494-99 (1997); Handbook of Chemical Property Estimation Methods, W. J. Lyman, W. F. Reed, D. H. Rosenblatt, McGraw Hill (1982).

Figure 4:
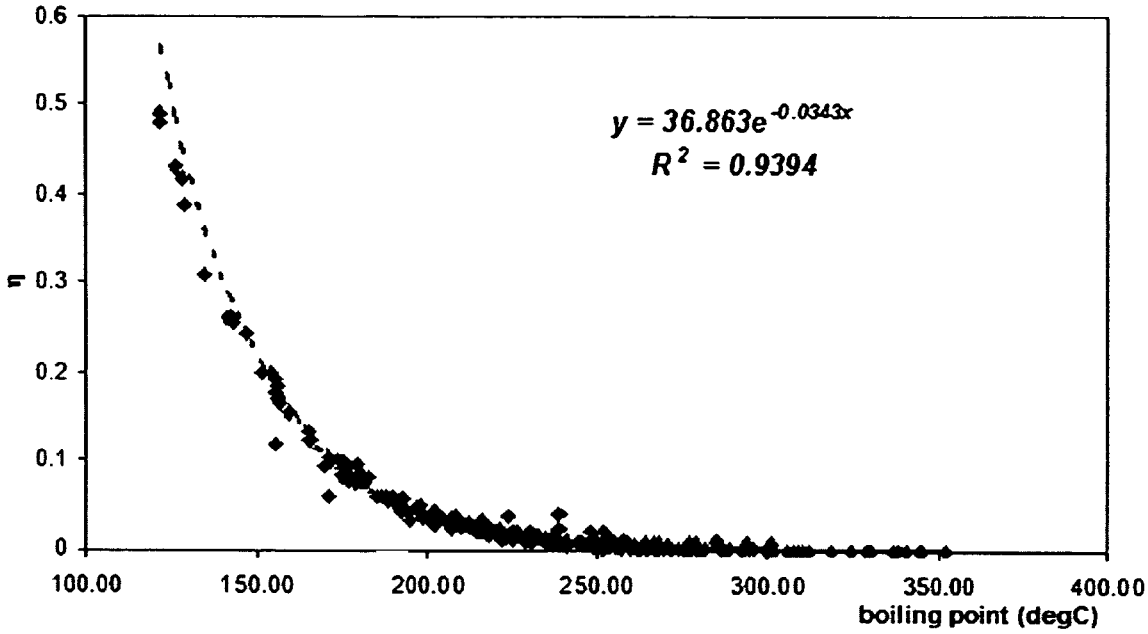
FIG. 4 is graph showing the relationship between cold throw and clogP values of odorants according to the present invention.
Figure 5:
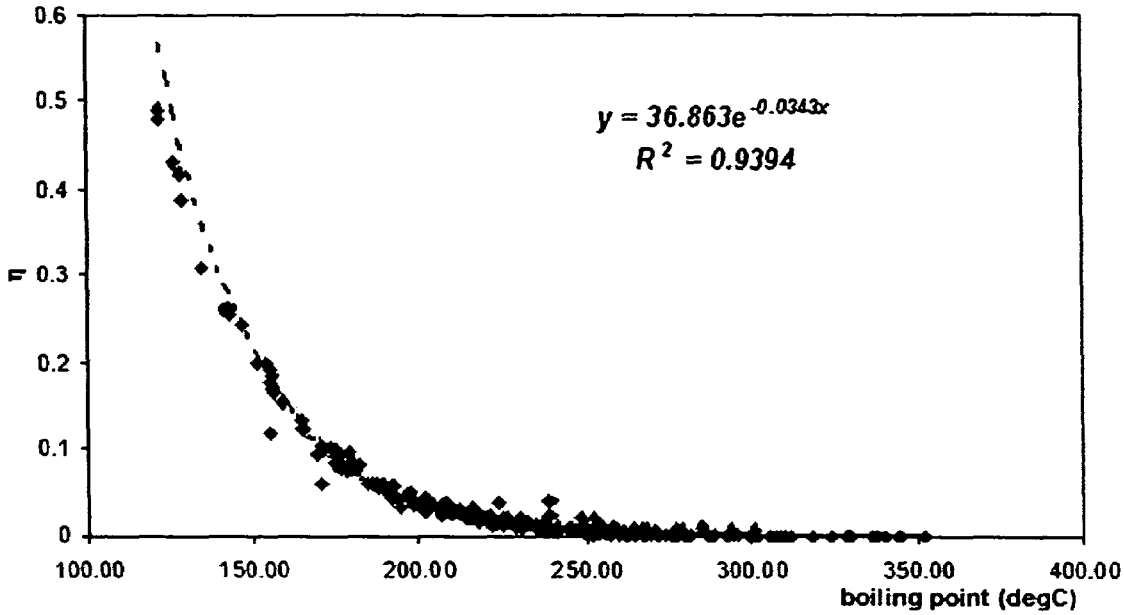
FIG. 5 is graph showing the relationship between hot throw and enthalpy of vaporization $\Delta H_{vap}$ in odorants according to the present invention.

As shown in FIG. 4 (Dependence of Hot Throw (η) on boiling point values) and FIG. 5 (Dependence of Hot Throw (η) on enthalpy of vaporization $\Delta H_{vap}$), there is a very strong correlation between the hot throw values calculated and odorants' boiling points. Boiling point values of less than 250° C. are used to select for odorants giving optimized hot throw (η) in wax systems 6. Selecting Odorants Base Upon Odor Indices Upon their release in headspace, odorants are detected based on their odor detection threshold values. Odor detection thresholds are defined as the lowest concentration of odorants in a selected medium (air or water) to be detected. By including odor index values of odorants in the model, one can further improve on the values for predicted performance of perfumes during cold and hot throw condition in candles.

In this invention, Odor Index (O.I.) values are calculated theoretically for odorants in air. These odor index values show a strong correlation with experimental odor detection thresholds in air as shown later in this patent.

An example of how the inventors calculate mathematically these odor indices, the conformation of 1-undecanal deduced from docking experiments into $hOBP_{IIa}$ is used below.

a. Modeling of $hOBP_{IIa\alpha}$ Binding Site and Odorant Docking Experiments

Figure 6:
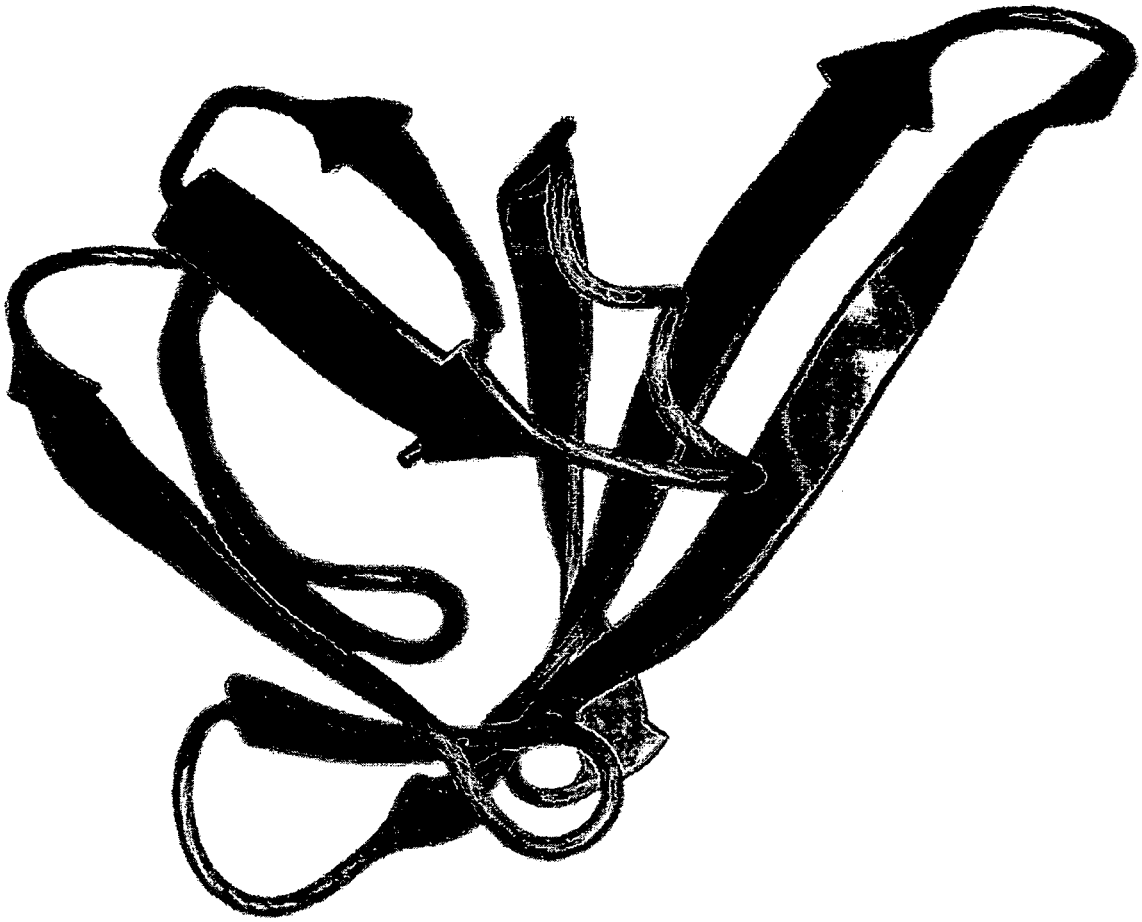
FIG. 6 is a perspective view of a modeled tertiary structure of the human odorant binding protein $hOBP_{Hal}$ employed in one example performed according to the present invention.

Human odorant binding protein $hOBP_{IIa\alpha}$ (17.8 kDa), belongs to the Lipocalin family. The amino acid sequence is 45.5% similar to the rat $OBP_{II}$ and 43% similar to the human tear lipocalin (TL-VEG). The tertiary structure of $hOBP_{IIa\alpha}$ was obtained using the automated SWISS-MODEL protein modeling service (http://swissmodel.expasy.org/). The modeled structure along with the modeled protein binding site is shown below:

FIG. 6 shows predicted tertiary structure for $hOBP_{IIa\alpha}$. The eight-stranded β-barrel, a common motif for lipocalins is present as well as two alpha helices (as also predicted by Lacazette et al., Human Molecular Genetics, 2000, 9, 2, 289-301).

Figure 7:
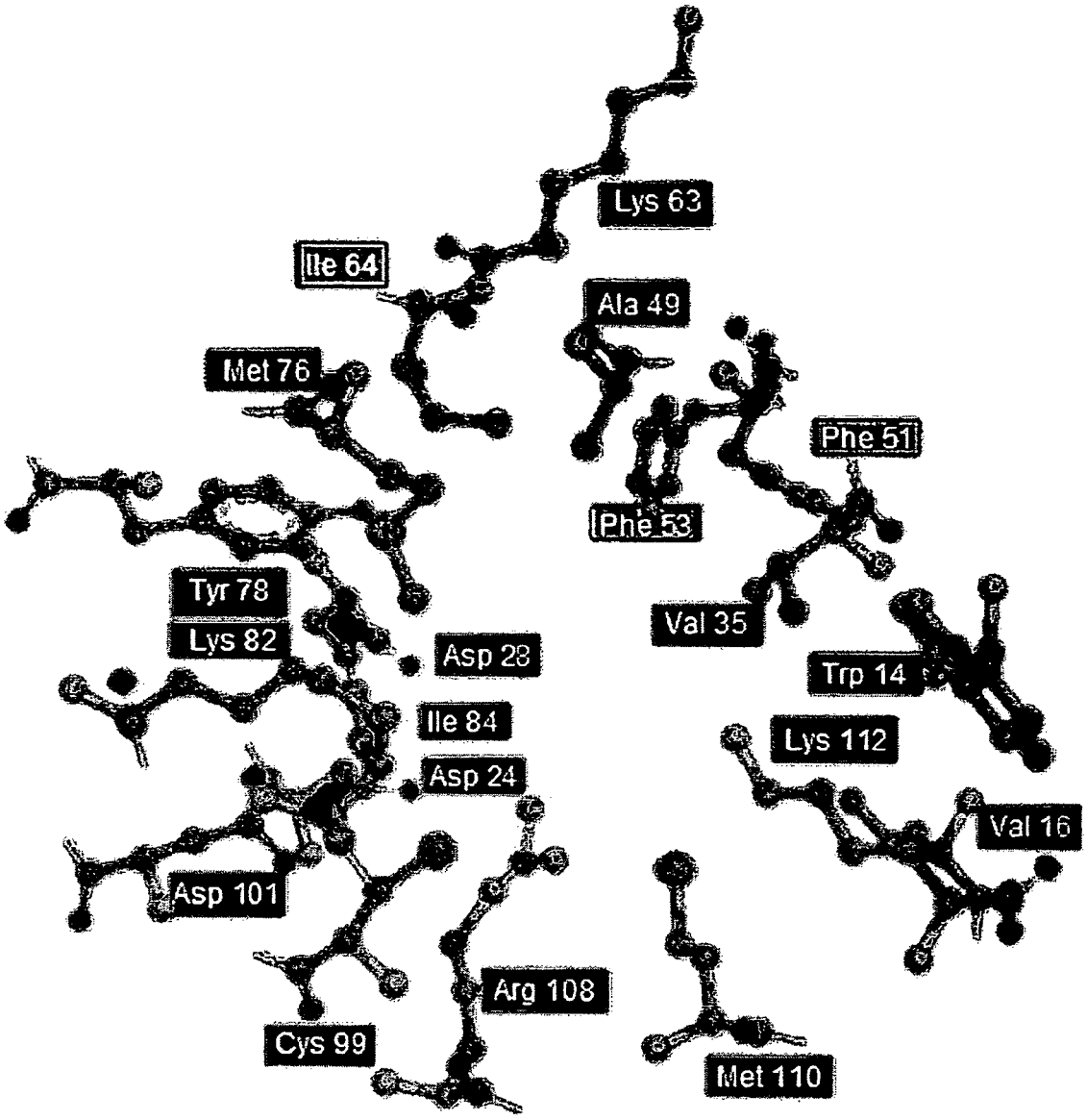
FIG. 7 is a perspective view of a modeled binding site of the human odorant binding protein $hOBP_{IIa\alpha}$ of FIG. 6.

FIG. 7 shows modeled binding site for $hOBP_{IIa\alpha}$. The conserved hydrophobic amino acids described by Lacazette et al. and thought to interact with ligands are shown.

Figure 8:
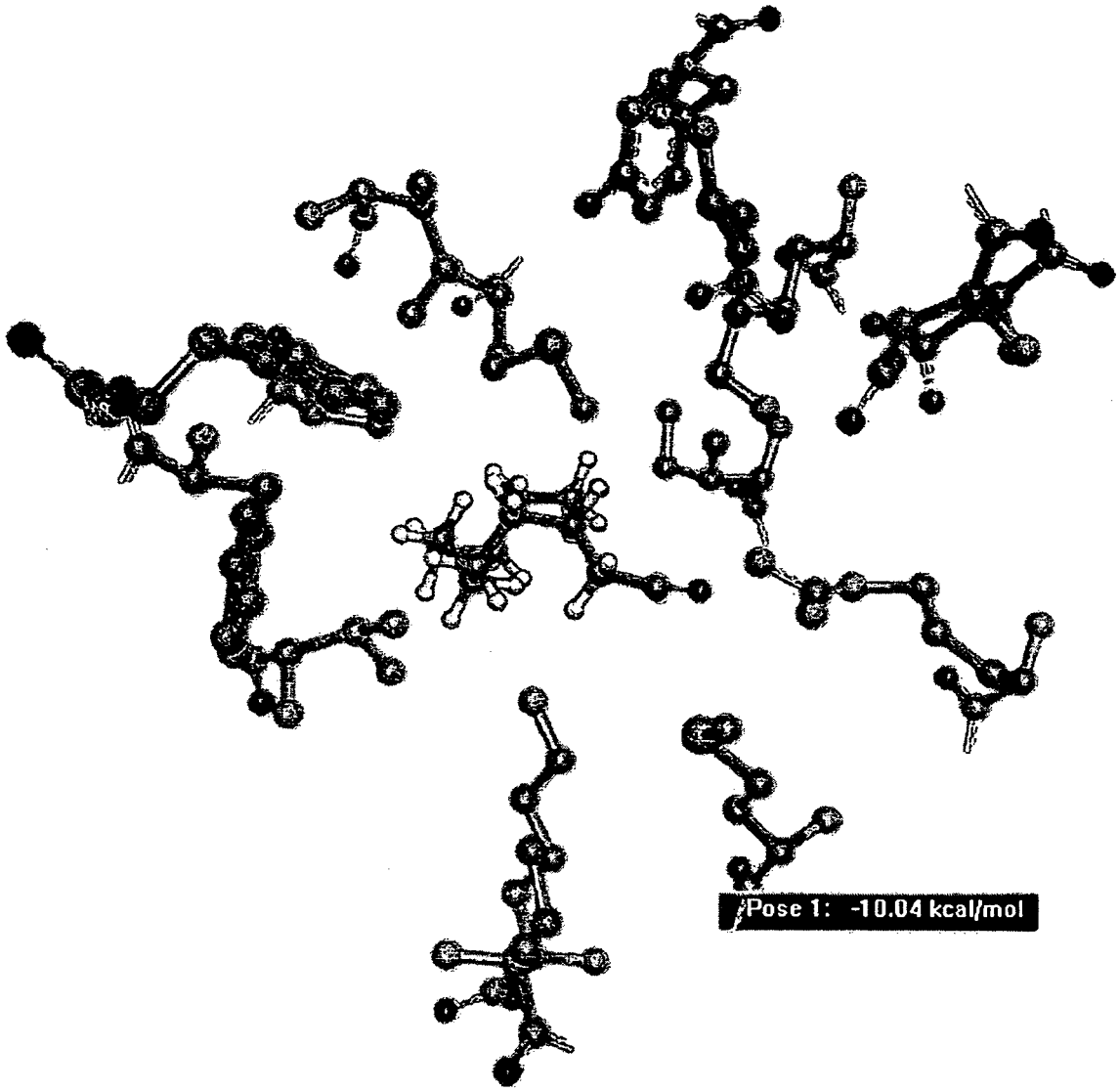
FIG. 8 is a perspective view of a modeled docked conformation of the odorant 1-undecanal in the $hOBP_{IIa\alpha}$ of FIG. 7.

FIG. 8 shows a docked conformation of 1-undecanal in the $hOBP_{IIa\alpha}$ binding cavity using a box size of 19×19.75×15.5 angstroms. The pose shown has docking energy of −10.05 kcal/mol. As an example, 1-undecanal was docked into the binding cleft of $hOBP_{IIa\alpha}$ using Argus lab software 4.0.1. in order to obtain the recognized conformation of the odorant (http://www.planaria-software.com/arguslab40. htm). The docked conformation of 1-undecanal within the binding cleft of the hOBP is show in FIGS. 8 and 9.

Figure 9:
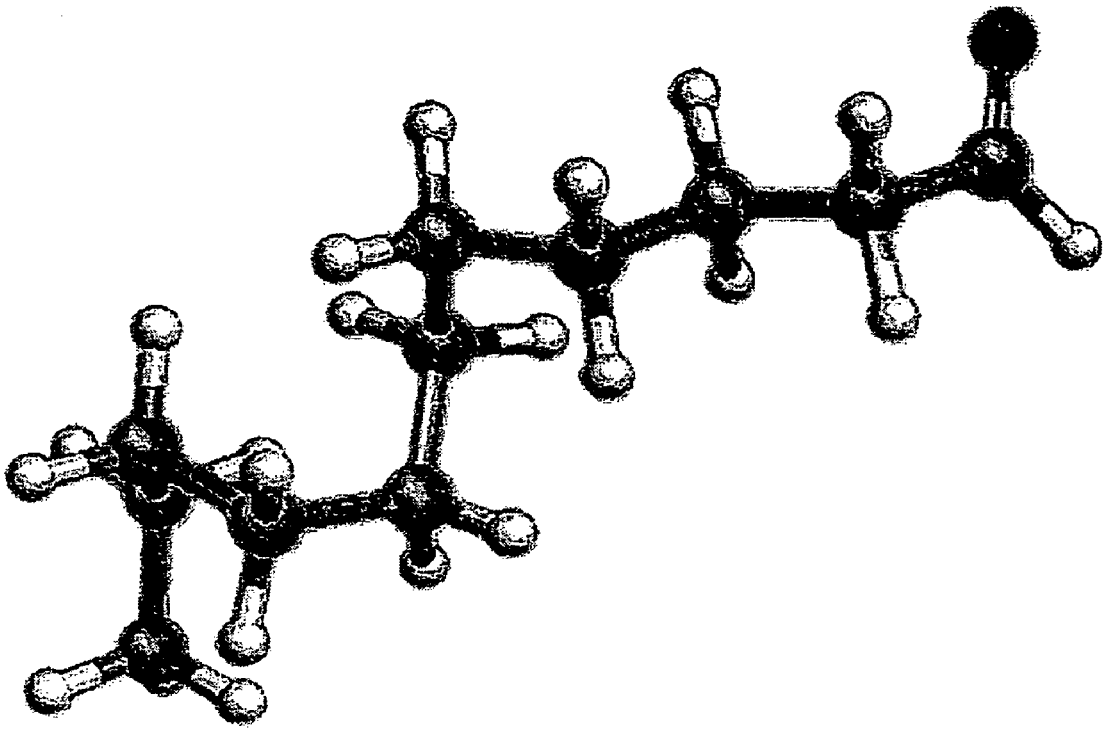
FIG. 9 is a perspective view of a modeled conformation of the odorant 1-undecanal of FIG. 8, used to calculate odor index value according to the present invention.

FIG. 9 shows 1-Undecanal Conformation used in odor index calculation: the conformation for 1-undecanal was deduced from docking experiment into the binding cleft of $hOBP_{IIa\alpha}$. The most energetically favored 1-undecanal conformation is shown in FIG. 9. This conformation is the used to calculate the maximum moment of inertia using a mathematical model of inertial ellipse.

b. Odor Index Calculation i. Moment of Inertia

The inertial ellipse (which is fixed in the rigid body) rolls and reorients on the invariable plane. The path followed on the plane is called the herpolhode. The tip of the vector on the inertial ellipse in which the total angular momentum L is normal rotates on the ellipse to form a path called the polhode. The polhode is the property of the odorant molecule. The invariable plane is a hypothetical plane external to the molecule, which can "fit" into the receptor. The herpolhode is a curve on a surface defining a receptor site "geometry". The height in which the inertial ellipse sits above the plane is inversely related to the ratio of rotational/translational forces.

The inertial ellipse incorporates the moment of inertia and angular momentum (L) of the odorant in the reference frame in which L is fixed in space.

ii. Translational/Rotational Constant

The translational/rotational constant is a ratio of translational to rotational energy. This factor is found to correlate to the type of functional group and most importantly to the Lydersen critical property increments.

Figure 10:
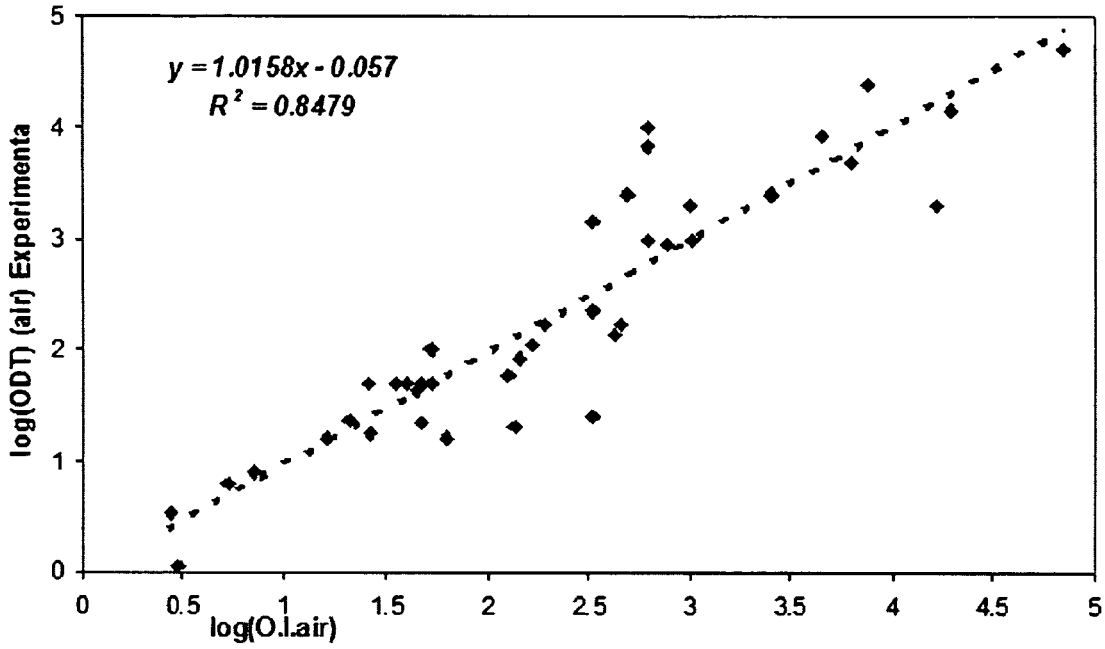
FIG. 10 is a graph showing the relationship of odor index value and experimental odor detection threshold values in odorants according to the present invention.

Conformation of 1-undecanal shown in FIG. 10 was used to calculate the odor index value of 1-undecanal both in air and in water as an illustrative example. The odor index value in air was found to be equal 0.000219 mg/m$^3$. The experimental value for odor detection threshold in air was determined to be 0.00054 mg/m$^3$ by Randenbrock (See Randebrock, R. E. (1986) Perfuem. Kosmet. 67, 1, 10-24). Calculated odor index in water was calculated to be equal to 8.2 parts per billion (ppb), and found to be within the experimental range determined by Schnabel et al. (Schnabel, K. O. Belitz, H. D., Von Ranson, C. (1988) Lebensm. Unters. Forsch. 187, 215-223).

iii. Odor Index Calculation for Various Odorants

The model and algorithm for odor index calculation was further applied to odorants from various chemical classes. The correlation results with published experimental odor detection thresholds as seen in FIG. 10.

FIG. 10 shows the correlation between the experimental odor detection threshold values from the "Compilations of Odor Threshold Values in Air" from the Booleans Aroma Chemical Information Service (BACIS) and calculated odor indices of various odorants. (All values are shown in mg/m$^3$.)

EXAMPLES

The following examples are presented to further illustrate and explain the present invention and should not be taken as limiting in any regard. All perfumes were put in a candle using paraffin wax from The International Group, Inc. (IGI) using IGI type 4876 at 3% concentration.

Example 1

Perfume Design of Hyacinth

A hyacinth "throw accord" was used to optimize cold and burn performance of an already existing hyacinth-type fragrance. Different percentages of the "throw accord" were added to the fragrance in order to improve its performance in a candle system.

TABLE 1

Candle Hyacinth-Type Fragrance

| | parts | clogP | boiling point ° C. | MW |
|---|---|---|---|---|
| HEXYL CINNAMIC ALDEHYDE | 2.7 | 4.9 | 308 | 216.3 |
| AMYL CINNAMIC ALDEHYDE | 0.72 | 4.83 | 284 | 202.3 |
| LINALYL ACETATE | 0.6 | 4.39 | 220 | 196.3 |
| HELIOTROPIN | 0.4 | 1.77 | 263 | 150.1 |
| LYRAL | 1 | 3.32 | 280 | 210.3 |
| GALAXOLIDE 50 IPM | 1 | 6.06 | 345 | 258.4 |
| TRICYCLODECENYL PROPIONATE | 0.4 | 3.68 | 276 | 206.28 |
| GIVESCONE | 0.18 | 4.83 | 266 | 210.17 |
| GALBANUM RESIN PURE 10% IN BENZYL BENZOATE | 0.2 | | | |
| HEDIONE HC | 0.02 | 209 | 307 | 226.31 |
| ETHYL VANILLIN 10% IN BENZYL BENZOATE | 0.02 | 1.81 | 285 | 166.18 |

TABLE 2

Candle Hyacinth "Throw Accord"

| | parts | clogP | boiling point ° C. | MW |
|---|---|---|---|---|
| BENZYL ACETATE | 2.5997 | 2.08 | 216 | 150.18 |
| PHENYL ETHYL ALCOHOL | 12.9983 | 1.57 | 219 | 122.17 |
| CYCLAL C | 0.1733 | 2.67 | 189 | 138.21 |
| LINALOOL | 4.3328 | 3.28 | 198.5 | 154.25 |
| PHENYL ACETALDEHYDE DIMETHYL ACETAL | 0.13 | 1.93 | 220 | 166.22 |
| HYDROXYCITRONELLAL PURE, FCC | 5.1993 | 2.11 | 241 | 172.27 |
| HYDRATROPIC ALDEHYDE | 0.0867 | 1.96 | 202 | 134.18 |
| MELONAL | 0.0173 | 3 | 188 | 140.23 |
| ISOEUGENOL | 0.0867 | 2.65 | 267 | 164.20 |
| NEOFOLIONE | 0.0433 | 3.6 | 216 | 170.25 |
| BENZYL ALCOHOL | 4.3328 | 1.08 | 205 | 108.14 |

The above mixtures for hyacinth perfume type and hyacinth "throw accord" were then mixed at the following concentrations:

TABLE 3

| Fragrance | Hyacinth-Type Perfume | Hyacinth "Throw Accord" |
|---|---|---|
| Hyacinth A | 100% | |
| Hyacinth B | 70% | 30% |
| Hyacinth C | 50% | 50% |

Example 2

Perfume Design of Green Fruity Floral

A green fruity floral-type fragrance was also optimized and improved for better hot and cold throw by adding a green fruity floral "throw accord" constructed based on the mass transfer values of its constituting odorants. The "throw accord" was added at different concentrations to the green fruity floral-type perfume.

TABLE 4

Green Fruity Floral-Type Fragrance

| | parts | clogP | boiling point ° C. | MW |
|---|---|---|---|---|
| AMYL CINNAMIC ALDEHYDE | 11.84 | 4.33 | 288.5 | 202.3 |
| HEXYL CINNAMIC ALDEHYDE | 11.92 | 4.9 | 308 | 216 |
| FLORALOZONE | 11.92 | 3.72 | 268 | 190.29 |
| BENZYL SALICYLATE | 11.92 | 4.31 | 335 | 228.25 |
| GALAXOLIDE 50 IPM | 4.56 | 6.06 | 345 | 258.4 |
| LILIAL | 7.28 | 4.36 | 278 | 204.31 |
| LYRAL | 11.92 | 3.32 | 280 | 210.32 |
| HYDROXYCITRONELLAL PURE, FCC | 6.16 | 2.11 | 241 | 172.27 |
| SANDALORE | 1.2 | 5.15 | 276 | 210.36 |
| TRICYCLODECENYL PROPIONATE | 1.28 | 3.68 | 276 | 206.28 |

TABLE 5

| Green Fruity Floral Throw Accord | Parts | clogP | boiling point ° C. | MW |
|---|---|---|---|---|
| DIHYDROMYRCENOL | 3.03 | 3.6 | 192 | 156.27 |
| IONONE BETA PURE | 1.01 | 4.42 | 255 | 192.3 |
| LINALOOL | 5 | 3.28 | 198.5 | 154.25 |
| MELONAL | 0.05 | 3 | 188 | 140.23 |
| ETHYL ACETOACETATE | 0.91 | 0.33 | 181 | 130.14 |
| GAMMA UNDECALACTONE | 0.96 | 2.92 | 286 | 184.28 |
| 2,6 NONADIEN-1-OL | 0.01 | 2.71 | 207 | 140.22 |
| BENZYL ALCOHOL | 0.09 | 1.08 | 205 | 108.14 |
| CIS-3-HEXEN-1-OL | 0.29 | 1.61 | 156 | 100.16 |
| PHENYL ETHYL ALCOHOL | 3.65 | 1.57 | 219 | 122.17 |
| HYDROXYCITRONELLAL PURE, FCC | 5 | 2.11 | 241 | 172.27 |

The above mixtures for Green Fruity Floral perfume were then mixed at the following concentrations:

TABLE 6

| Fragrance | Green Fruity Floral-type Fragrance | Green Fruity Floral Throw Accord |
|---|---|---|
| Green Fruity Floral Type | 100 | 0 |
| Green Fruity Floral A | 80 | 20 |
| Green Fruity Floral B | 70 | 30 |
| Green Fruity Floral C | 40 | 60 |

All fragrances were then evaluated both analytically and hedonically using the below mentioned methods.

Analytical evaluation of perfume cold and hot throw in the constructed candles was evaluated using a standard solid phase micro-extraction method followed by a GC-MS analysis. The sampling fiber was allowed to equilibrate directly above the candle for five minutes in cold conditions and subsequently upon burning of the candles for five minutes in a 5 by 5 feet stainless steel chamber. The method is described in more detail below.

a. Gas Chromatography-Mass Spectroscopy and Sampling Method

Candle hot and cold throw were evaluated using GC-MS headspace analysis using the following method:

TABLE 7a

| Gas Chromatography Method | | |
|---|---|---|
| Oven | Initial Temperature | 55° C. |
| | Ramp Rate: | 25° C./min |
| | Final Temperature: | 260° C. |
| | Run Time: | 9.80 minutes |
| | Mode: | Splitless |
| | Initial Temperature: | 240° C. |
| | Pressure: | 24.90 Psi |
| | Total Flow: | 505.10 ml/min |
| | Temperature: | 250° C. |
| | Flow: | 40 ml/min |
| | Mode: | Constant pressure |
| | Make-up Gas: | Helium |
| Column | Type | Capillary |
| | Model | Phenomenex Zebron DB-1 |
| | Specs | 0.25 mm/60 m/0.25 □m |
| Mass Spectrum Determination | Low Mass: | 16.00 |
| | High Mass: | 455.00 |
| | Threshold: | 140 |

Sampling was performed using headspace analysis according to the following method for solid phase micro-extraction as listed in Table 7b.

TABLE 7b

| Gas Chromatography Method | |
|---|---|
| Equilibration | 5 minutes |
| SPME Fiber | 100 PDMS |
| Molecular | 30.0/280.0 |

The quantity of fragrance above the sample candle containing the above-mentioned perfumes at concentration of 3% was measured using a standard solid phase micro-extraction method, followed by analysis by GC-Mass Spec according to the method described above. The amount of perfume in headspace was quantified during burn and in cold conditions based on total ion chromatogram (TIG) relative abundance (r/a).

The results are summarized below:

Example 1

Hyacinth

TABLE 8

| Cold Throw Headspace Sampling | |
|---|---|
| Fragrance | r/a |
| Hyacinth A | 240000 |
| Hyacinth B | 360000 |
| Hyacinth C | 450000 |

TABLE 9

| Hot Throw Headspace Sampling | |
|---|---|
| Fragrance | r/a |
| Hyacinth A | 670000 |
| Hyacinth B | 760000 |
| Hyacinth C | 820000 |

Example 2

Green Fruity Floral

TABLE 10

| Cold Throw Sampling | |
|---|---|
| Fragrance | r/a |
| Green Fruity Floral-type | 200000 |
| Green Fruity Floral A | 260000 |
| Green Fruity Floral B | 380000 |
| Green Fruity Floral C | 500000 |

TABLE 11

| Hot Throw Sampling | |
|---|---|
| Fragrance | r/a |
| Green Fruity Floral-type | 380000 |
| Green Fruity Floral A | 500000 |
| Green Fruity Floral B | 650000 |
| Green Fruity Floral C | 850000 |

b. Hedonic Evaluation

As part of the hedonic evaluation of perfumery, the odor indices values of the odorants composing the accords added to improve the hot and cold throw of the fragrances were calculated according to the methods described above in the herein invention. The odor indices in air are shown below along with calculated odor indices obtained in water to illustrate the perceived modeled thresholds of these odorants in different media.

Example 1

Candle Hyacinth Throw Accord

TABLE 12

| | Parts | Odor Indices (air) mg/m$^3$ | Odor Indices (water) (ppb) |
|---|---|---|---|
| BENZYL ACETATE | 2.5997 | 0.019 | 28 |
| PHENYL ETHYL ALCOHOL | 12.9983 | 0.160 | 984 |
| CYCLAL C | 0.1733 | 0.0024 | 14 |
| LINALOOL | 4.3328 | 0.0026 | 10 |
| PHENYL ACETALDEHYDE DIMETHYL ACETAL | 0.13 | 0.0022 | 5.5 |
| HYDROXYCITRONELLAL | 5.1993 | 0.05 | 15 |
| HYDRATROPIC ALDEHYDE | 0.0867 | 0.04 | 65 |
| MELONAL | 0.0173 | 0.0018 | 18.5 |
| ISOEUGENOL | 0.0867 | 0.11 | 107 |
| NEOFOLIONE | 0.0433 | 0.00001 | 0.21 |
| BENZYL ALCOHOL | 4.3328 | 0.4 | 917 |

Example 2

Green Fruity Floral Throw Accord

TABLE 13

| | Parts | Odor Index (air) mg/m$^3$ | Odor Index (water) ppb |
|---|---|---|---|
| DIHYDROMYRCENOL | 3.03 | 0.052 | 117 |
| IONONE BETA PURE | 1.01 | 0.0004 | 3 |
| LINALOOL | 5 | 0.0026 | 10 |
| MELONAL | 0.05 | 0.0018 | 18.5 |
| ETHYL ACETOACETATE | 0.91 | 0.0053 | 24 |
| GAMMA UNDECALACTONE | 0.96 | 0.0002 | 0.3 |
| 2,6 NONADIEN-1-OL | 0.01 | 0.003 | 4 |
| BENZYL ALCOHOL | 0.09 | 0.4 | 917 |
| CIS-3-HEXEN-1-OL | 0.29 | 0.018 | 25 |
| PHENYL ETHYL ALCOHOL | 3.65 | 0.191 | 984 |
| HYDROXYCITRONELLAL | 5 | 0.05 | 15 |

A panel of 20 experts made of perfumers and perfume evaluators was used to evaluate hedonically the above-described candles based on their intensity during cold and burn conditions.

The candles' performance was scored on a ten-point scale, with 1 for no detection and 10 being the highest. The candles were evaluated cold. The perfume intensity during burn was assessed after an equilibration time of 30 minutes in an enclosed plexiglass chamber of 3 ft by 4 ft. The results are summarized below:

Example 1

Hyacinth

TABLE 14

Cold Throw Hedonic Evaluation

| Fragrance | Intensity |
|---|---|
| Hyacinth A | 5.5 |
| Hyacinth B | 6.9 |
| Hyacinth C | 5.6 |

TABLE 15

Hot Throw Hedonic Evaluation

| Fragrance | Intensity |
|---|---|
| Hyacinth A | 4.2 |
| Hyacinth B | 5.9 |
| Hyacinth C | 6.1 |

Example 2

Green Fruity Floral

TABLE 16

Cold Throw Hedonic Evaluation

| Fragrance | Intensity |
|---|---|
| Green Fruity Floral A | 4.9 |
| Green Fruity Floral B | 5.6 |
| Green Fruity Floral C | 5.8 |

TABLE 17

Hot Throw Hedonic Evaluation

| Fragrance | Intensity |
|---|---|
| Green Fruity Floral A | 5.2 |
| Green Fruity Floral B | 5.8 |
| Green Fruity Floral C | 6.1 |

The above description is for the purpose of teaching the person of ordinary skill in the art how to practice the present invention, and it is not intended to detail all those obvious modifications and variations of it which will become apparent to the skilled worker upon reading the description. It is intended, however, that all such obvious modifications and variations be included within the scope of the present invention, which is defined by the following claims. The claims are intended to cover the claimed components and steps in any sequence which is effective to meet the objectives there intended, unless the context specifically indicates the contrary.

What is claimed is:

1. A candle with optimized cold and hot fragrance throw, comprising:

wax material; and a fragrance component incorporated into the wax material, the fragrance component containing at least 20% by weight at least one odorant selected based upon having:

cold throw value (Ω) of at least about $$1\times10^{-8}\left(\frac{\text{mg}\cdot\text{cm}}{\text{cm}^2\cdot\text{sec}^2}\right)\cdot\frac{1}{\text{sec}},$$

and hot throw value (η) of at least about $$0.01\left(\frac{\text{g}\cdot\text{cm}}{\text{cm}^2\cdot\text{sec}^2}\right)*\frac{\text{cm}^2}{\text{sec}}.$$

2. The candle of claim 1, wherein the cold throw value is greater than about $$1\times10^{-7}\left(\frac{\text{mg}\cdot\text{cm}}{\text{cm}^2\cdot\text{sec}^2}\right)\cdot\frac{1}{\text{sec}}.$$

3. The candle of claim 1, wherein the hot throw value is greater than $$0.02\left(\frac{\text{g}\cdot\text{cm}}{\text{cm}^2\cdot\text{sec}^2}\right)*\frac{\text{cm}^2}{\text{sec}}.$$

4. The candle of claim 1, wherein at least one odorant has:

boiling point less than about 275° C., clogP value less than about 4.5, and molecular weight less than about 200.

5. The candle of claim 1, wherein the fragrance component contains at least about 30% by weight odorant or odorants.

6. The candle of claim 1, wherein the at least one odorant further has an odor index value of about 0.025 ($mg/m^3$) or less.

7. The candle of claim 1, wherein the wax material is selected from the group consisting of paraffin, vegetable-derived wax, and combinations of these.

8. The candle of claim 1, wherein the candle comprises at least about 0.1% by weight fragrance component.

9. The candle of claim 4, wherein the boiling point is from about 65° C. to about 250° C.

10. The candle of claim 4, wherein the clogP value is from about 1.5 to about 4.5.

11. The candle of claim 10, wherein the clogP value is from about 2.0 to about 3.5.

12. A fragrance composition for use in hydrophobic systems, comprising:

at least 20% by weight at least one odorant to form a desired fragrance, each odorant selected based upon having:

cold throw value (Ω) of at least about $$1\times10^{-8}\left(\frac{\text{mg}\cdot\text{cm}}{\text{cm}^2\cdot\text{sec}^2}\right)\cdot\frac{1}{\text{sec}},$$

and hot throw value (η) of at least about $$0.01\left(\frac{\text{g}\cdot\text{cm}}{\text{cm}^2\cdot\text{sec}^2}\right)*\frac{\text{cm}^2}{\text{sec}};$$

and a hydrophobic carrier containing the fragrance.

13. The fragrance composition of claim 12, wherein the cold throw value is greater than about $$1\times10^{-7}\left(\frac{\text{mg}\cdot\text{cm}}{\text{cm}^2\cdot\text{sec}^2}\right)\cdot\frac{1}{\text{sec}}.$$

14. The fragrance composition of claim 12, wherein the hot throw value is greater than about $$0.02\left(\frac{\text{g}\cdot\text{cm}}{\text{cm}^2\cdot\text{sec}^2}\right)*\frac{\text{cm}^2}{\text{sec}}.$$

15. The fragrance composition of claim 12, wherein at least one odorant has:

cLogP value less than about 4.5, and boiling point less than about 275° C.

16. The fragrance composition of claim 12, comprising at least about 30% by weight odorant or odorants.

17. The fragrance compositions of claim 12, wherein at least one odorant has an odor index value of about 0.025 ($mg/m^3$) or less.

18. The fragrance composition of claim 12, wherein at least one odorant has molecular weight less than about 200.

19. The fragrance composition of claim 12, wherein the hydrophobic carrier is a wax material selected from the group consisting of paraffin, vegetable-derived wax, and combinations of these.

20. The fragrance composition of claim 15, wherein the boiling point is from about 65° C. to about 250° C.

21. The fragrance composition of claim 15, wherein the clogP value is from about 1.5 to about 4.5.

22. The fragrance composition of claim 21, wherein the clogP value is from about 2.0 to about 3.5.

23. A method of fragrance optimization in hydrophobic systems, comprising:

providing a wax material;

selecting at least one odorant to form 20% by weight of a desired fragrance, each odorant having:

cold throw value (Ω) of at least about $$1\times10^{-8}\left(\frac{\text{mg}\cdot\text{cm}}{\text{cm}^2\cdot\text{sec}^2}\right)\cdot\frac{1}{\text{sec}},$$

and hot throw value (η) of at least about $$0.01\left(\frac{\text{g}\cdot\text{cm}}{\text{cm}^2\cdot\text{sec}^2}\right)*\frac{\text{cm}^2}{\text{sec}};$$

and incorporating the fragrance into the wax material.

24. The method of claim 23, wherein the cold throw value is greater than about $$1\times10^{-7}\left(\frac{\mathrm{mg}\cdot\mathrm{cm}}{\mathrm{cm}^2\cdot\mathrm{sec}^2}\right)\cdot\frac{1}{\mathrm{sec}}.$$

25. The method of claim 23, wherein the hot throw value is greater than about $$0.02\left(\frac{\mathrm{g}\cdot\mathrm{cm}}{\mathrm{cm}^2\cdot\mathrm{sec}^2}\right)*\frac{\mathrm{cm}^2}{\mathrm{sec}}.$$

26. The method of claim 23, further comprising selecting at least one odorant having:

cLogP value less than about 4.5, and boiling point less than about 275° .

27. The method of claim 23, wherein the fragrance comprises additives and at least about 30% by weight odorant or odorants.

28. The method of claim 23, wherein at least one odorant has an odor index value of about 0.025 ($mg/m^3$) or less.

29. The method of f claim 23, wherein at least one odorant has molecular weight less than about 200.

30. The method of claim 23, wherein the wax material is selected from the group consisting of paraffin, vegetable-derived wax, and combinations of these.

31. The method of claim 26, wherein the boiling point is from about 65° C. to about 250° C.

32. The method of claim 26, wherein the clogP value is from about 1.5 to about 3.5.

33. The method of claim 30, wherein the clogP value is from about 2.0 to about 3.5.

* * * * *